United States Patent [19]

Janhonen

[11] Patent Number: 4,627,223

[45] Date of Patent: Dec. 9, 1986

[54] PACKAGE BLANK AND PACKAGING METHOD

[76] Inventor: Veikko I. Janhonen, Långvik, 02420 Jorvas, Finland

[21] Appl. No.: 541,328

[22] PCT Filed: Jan. 26, 1983

[86] PCT No.: PCT/FI83/00006

§ 371 Date: Sep. 26, 1983

§ 102(e) Date: Sep. 26, 1983

[87] PCT Pub. No.: WO83/02764

PCT Pub. Date: Aug. 18, 1983

[30] Foreign Application Priority Data

May 5, 1982 [FI] Finland ..... 821571
Feb. 5, 1983 [FI] Finland ..... 820384

[51] Int. Cl.[4] ..... B65B 11/58

[52] U.S. Cl. ..... 53/449; 53/399; 206/441; 229/87 R

[58] Field of Search ..... 53/399, 449; 206/441; 229/81 R; 283/34

[56] References Cited

U.S. PATENT DOCUMENTS

| | | | |
|---|---|---|---|
| 2,011,703 | 8/1935 | Barker | 206/424 X |
| 2,071,232 | 2/1937 | Langehenning | 281/34 X |
| 3,217,868 | 11/1965 | Champlin et al. | 206/424 |
| 3,253,379 | 5/1966 | Foradora | 53/449 X |
| 3,986,657 | 10/1976 | Angelini | 206/424 X |

FOREIGN PATENT DOCUMENTS

| | | | |
|---|---|---|---|
| 2026553 | 9/1970 | France | 206/424 |
| 2307707 | 11/1976 | France | 206/424 |
| 2297785 | 10/1977 | France . | |
| 2311729 | 8/1979 | France . | |
| 256382 | 2/1949 | Switzerland . | |
| 7415301 | 9/1976 | Switzerland . | |
| 284217 | 10/1970 | U.S.S.R. . | |
| 1036242 | 2/1976 | U.S.S.R. . | |

*Primary Examiner*—Paul A. Bell

*Attorney, Agent, or Firm*—Price, Heneveld, Huizenga & Cooper

[57] ABSTRACT

The package comprises a flat, rectangular cardboard sheet (1) and a separate wrapper element (2) made of a flexible material. A problem to be resolved is to provide a package which is readily and quickly manually wrappable and is suitable for use with varying amounts of goods. To resolve this problem, the separate wrapper element (2) is adhered by gluing transversely to the surface of said cardboard sheet. The wrapping is effected in such a manner that a product to be wrapped up, which is narrower than the width of said cardboard sheet, is wrapped in wrapper element (2) and the ends of said cardboard sheet are overlapped on top of the product against each other and therearound is tightened a binding strip (6), extending transversely of the cardboard sheet and urging the freely extending edge portions of said cardboard sheet towards each other.

4 Claims, 5 Drawing Figures

PACKAGE BLANK AND PACKAGING METHOD

BACKGROUND OF THE INVENTION

The present invention relates to a package blank, comprising a flat, rectangular cardboard sheet and a wrapper element made of a flexible material. The invention also relates to a packaging method, employing a package blank according to the invention.

One prior art package comprises a pouchlike wrapper element between the halves of a cardboard sheet, folded like the covers of a book, the goods to be wrapped being placed in said wrapper which also retains the goods between the halves of a protective covering made up by said cardboard sheet. This type of package requires that various sizes of packages be used respectively for goods of various bulks and amounts. The manufacture amd assortment of a selection comprising a plurality of package sizes nevertheless requires extra work.

In another prior art package type, a package is manufactured by means of an automatic machine simultaneously with the wrapping of goods to be packed in a manner that a wrapper element is first wrapped around the goods and then attached to a cardboard sheet which is bent around the wrapper element and the goods contained therein. This requires an expensive automatic machine on a packaging site. However, it would often be preferable that packages were prefabricated to a sufficient degree so that the actual wrappinig could be later effected manually.

SUMMARY OF THE INVENTION

An object of the invention is to provide an above-described type of package blank which can be readily, quickly and manually loaded with a varying bulk of goods.

To achieve this objective, a package blank of the invention is characterized in that a separate wrapper element is adhered by gluing transversely to the surface of a cardboard sheet.

Such a package blank is extremely economical as to its material costs and, moreover, can be manufactured at high production rate with a relatively simple machinery.

When empolying such a package, the wrappinig operation according to the method of the invention is effected so that a product to be wrapped, which is narrower than the width of said cardboard sheet, is wrapped in said wrapper element and the ends of said carboard sheet are folded around the open sides of wrapper element into overlapping relationship against each other and that around the package if tightened a binding strip, extending transversely of the cardboard sheet and urging the freely extending edges of the cardboard sheet towards each other.

A particularly protective and durable package is accomplished this way.

In a preferred embodiment of the invention, the side edges of the cardboard sheet of a package blank are double folded and glued to provide side edge reinforcements that are narrow relative to the width of said cardboard sheet. Such edge reinforcements are of particular significance in view of the strength of a finished package in order to avoid cutting of a binding strip into the edge portion of a cardboard sheet and to make the outstanding corner portions resist blows and impacts as effectively as possible, so that such blows could not reach and damage the articles to be wrapped up.

BRIEF DESCRIPTION OF THE DRAWINGS

In the following description, some embodiments of the invention are illustrated with reference to the accompanying drawings, in which.

DESCRIPTION OF THE PREFERRED EMBODIMENT

Figure 1:
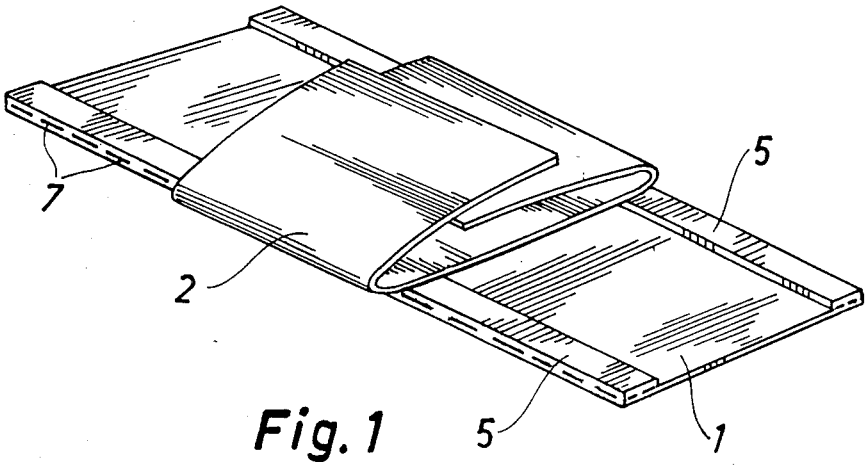
FIG. 1 is a perspective view of a package blank of the invention.

A package shown in FIG. 1 comprises two elements, namely a rectangular, flat cardboard sheet 1 and a wrapper element 2 made of a flexible material. In the present embodiment, the wrapper element 2 is a single continuous strip, adhered only by its central region to the surface of a cardboard sheet 1 substantially to the central area of said cardboard sheet 1. The length of strip 2 is at least approximately double the width of cardboard sheet 1. The width of strip 2 is less than half of the length of cardboard sheet 1.

The side edges of a cardboard sheet 1 are further double folded along creasing or perforation lines 7 and adhered to the face of said cardboard sheet 1 for side edge reinforcements 5 that are narrow relative to the width of a cardboard sheet.

The package blank is only intended for wrapping products that are narrower than the width of a cardboard sheet 1. Such a product, e.g. one or several books, is wrapped in wrapper element 2 and the ends of cardboard sheet 1 are overlapped around the open sides of wrapper element 2 against each other on top of the product. Tightened around a package or parcel obtained this way is a binding strip 2, extending transversely of the cardboard sheet and urging the freely extending edge portions of cardboard sheet 1 towards each other. Thus, the edge reinforcements 5 prevent the binding strip 6 from cutting into the edge of cardboard sheet 1. At the same time, the corners of package are made stiffer and more resistant to blows. The goods to be wrapped will be tightly and solidly clamped within a cardboard sheet 1.

Figure 3:
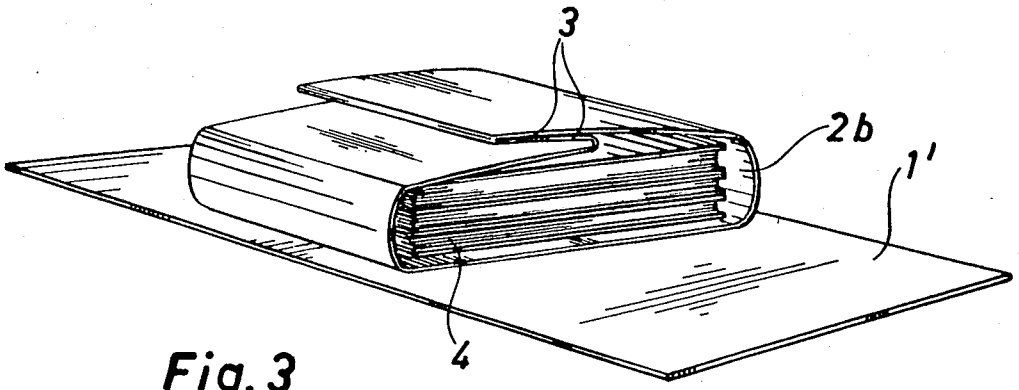
FIG. 3 shows a package of the invention in perspective view during the packaging operation.

A package shown in FIG. 3 consists of two elements, namely a rectangular, flat cardboard sheet 1' and a hose- or ring-shaped wrapper element **2*b*, the latter extending over a minor portion of the length of said cardboard sheet and being attached on the central region thereof. Cardboard sheet 1' is preferably cardboard fitted with transverse folding lines and hose 2*b* is paper, plastic film or a like flexible material. The open ends of hose 2*b* face the longitudinal direction of cardboard sheet 1', in other words, the circumference of hose 2*b* extends transversely of cardboard sheet 1'. The circumference of hose 2*b* is so great that it is always substantially more than the circumference of an article 4 to be later placed within the wrapper element. The special result obtained this way is that a smaller or larger amount of goods 4 to be packaged can be placed within hose 2*b* and, thus, by providing hose 2*b* with a fold 3, said hose 2*b* can always be tightened around an article or goods 4 to be packaged. If desired, a fold 3** can be bound by means of an adhesive tape or a pre-attached adhesive strip can be used thereat.

Figure 2:
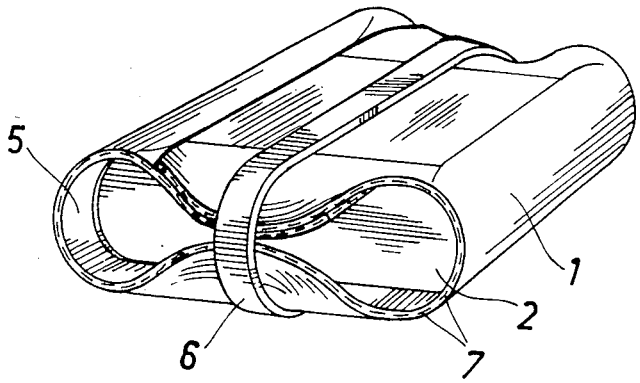
FIG. 2 shows a package made up from the package blank by the method of the invention.
Figure 4:
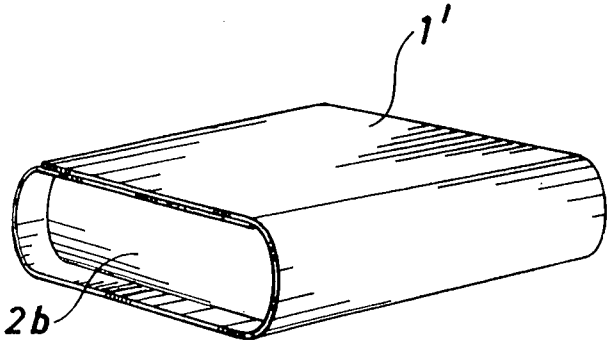
FIG. 4 shows a package of FIG. 3 in finished condition.

When goods 4 areplaced in position and fold 3 formed in wrapper 2*b*, both ends of cardboard sheet 1′ are bent around the open ends of wrapper 2*b* on top of the folded side of said wrapper, resulting in a finished package according to FIG. 4. Wrapper 2*b* keeps the goods within cardboard sheet 1′. The outstanding corners of cardboard sheet 1′ protect the goods effectively. If desired, the open ends of cardboard sheet 1′ can be shut off by pulling thereover an adhesive tape, string or a like as shown in FIG. 2.

Figure 5:
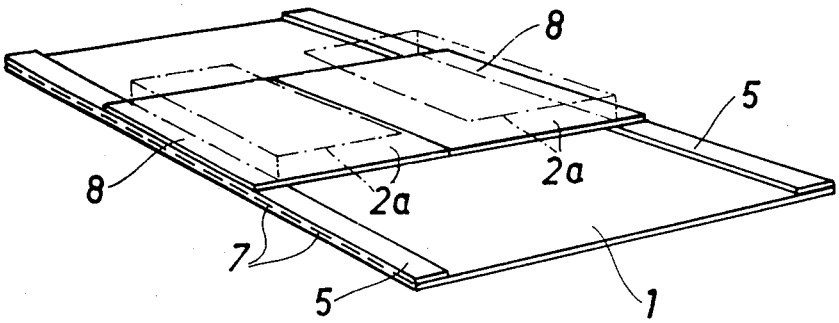
FIG. 5 is a perspective view of a package blank according to another embodiment of the invention.

Shown in FIG. 5 is a slightly modified package blank which differs from that shown in FIG. 1 in the sense that the wrapper element consists of two strips 2*a*, attached by its edges 8 adjacent to the edges of a cardboard sheet 1. Strips 2*a* extend with their free ends to the central region of cardboard sheet 1. The dash-and-dot lines in FIG. 5 illustrate the position of strips 2*a*, when a product to be wrapped, e.g. a book, is fitted in position between strips 2*a* and cardboard sheet 1. In the prior art, similar kind of package blanks have been made of one and the same cardboard sheet by punching which leads, however, to major material losses and requires expensive manufacturing machinery whose production rate is not sufficient relative to the costs.

On the other hand, in the manufacture of a package blank according to the invention, both a cardboard sheet and a wrapper element can be continuously driven on top of each other from supply rolls at a high rate. The ratio between the supply rates of the webs forming a cardboard sheet 1 and a wrapper element 2 is equal to that between the lengths of a cardboard sheet 1 and a wrapper element 2. Cutting of the webs to precise lengths can be effected e.g. between rotating cylinder cutters.

A certain amount of the wrapper element material can be saved in the embodiment of FIG. 5 compared to that shown in FIG. 1. In practice, however, the embodiment shown in FIG. 1 is substantially in preference to that shown in FIG. 5 for the following reasons. The manufacturing can be carried out with a considerably more simple machine and at a higher production rate since (1) the gluing area of a wrapper element 2 need not be accurately determined and (2) a single continuous wrapper element 2 is more readily installable than two separate wrapper elements 2*a*. Furthermore, in a finished package, the wrapper-up good loads wrapper element 2 with tensile stress and the glued area with shearing stress, a sufficient strength being always assured but, instead, the glue seams of two separate will be subjected to tearing, whereby they may disengage already as the goods are being wrapped up unless the strength of the glue seams and the splitting strengths of the employed materials are sufficient. This of course limits e.g. the choice of materials as compared to the embodiment shown in FIG. 1.

Essential to the invention is that the package always conforms tightly around the goods to be paracelled regardless of the bulk of the goods.

I claim:

1. A package blank comprising:

a flat, elongated, rectangular outer cardboard sheet free of laterally extending creases and fold lines, the longer edge portions of said outer sheet being folded back upon and bonded to an inner face of said outer sheet to reinforce the longer edges, said edge portions being of uniform width throughout their length; and an elongated, rectangular inner sheet of a flexible material free of laterally extending creases and fold lines, said outer sheet being of a material substantially stiffer than the material of said inner sheet, the length of said inner sheet being at least approximately double the width between the folded edges of said outer sheet, said inner sheet having a width less than half the length of said outer sheet; said inner sheet and said outer sheet being arranged perpendicularly to each other and adhesively secured together, whereby an article shorter than said width of said outer sheet can be wrapped and covered by said inner sheet and recessed between said folded edges of said outer sheet so that said edge portions protect the article and absorb impact.

2. A package blank as described in claim 1 further comprising a band encircling said outer sheet and urging said edge portions of said outer sheet to pinch together.

3. A method of packaging an article including the steps of:

providing an elongated rectangular cardboard outer sheet free of creases and fold lines and an elongated rectangular inner sheet of a flexible material having a width less than half the length of the outer sheet and free of creases and fold line;

folding the longer edge portions of the outer sheet inwardly against the inner face of the outer sheet and bonding them to the inner face, said edge portions being of uniform width throughout their lengths, the length of the inner sheet being at least double the width between the folded edges of the outer sheet;

arranging the sheets at right angles to and crossing each other substantially midway between their ends;

adhesively securing the sheets to each other;

placing the article at the center of the inner sheet and folding the inner sheet entirely around the article and forming it into a tube seated tightly about the article;

folding the outer sheet over the inner sheet to entirely encircle the inner sheet in a direction normal to the direction in which the inner sheet is wrapped about the article so that said edge portions form outwardly extending impact absorbing reinforced flanges extending outwardly from the article, the inner sheet retaining the article against movement lengthwise of the tube formed by the outer sheet by reason of the bonding between said inner and outer sheets.

4. A method of packaging an article as described in claim 3 further including the steps of:

wrapping a strap entirely around the center of the folded outer sheet in the direction in which the inner sheet encircles the article; and tensioning the strap sufficiently to force the edge portions of the outer sheet toward each other and thereby to partially encapsulate the wrapped article and further stiffen the outer edge corners of the package against impact.

* * * * *